US005566427A

United States Patent [19]

Lathrop

[11] Patent Number: 5,566,427

[45] Date of Patent: Oct. 22, 1996

[54] STRAP CLIP AND RETAINER

[76] Inventor: Kim N. Lathrop, 7230 SE. Market, Portland, Oreg. 97215

[21] Appl. No.: 226,873

[22] Filed: Apr. 13, 1994

[51] Int. Cl.[6] ..... A44B 11/02

[52] U.S. Cl. ..... 24/169; 24/200; 2/452

[58] Field of Search ..... 24/166, 167, 193, 24/197, 198, 200, 168, 169, 170; 2/452

[56] References Cited

U.S. PATENT DOCUMENTS

| | | | |
|---|---|---|---|
| 218,784 | 8/1879 | Shepard . | |
| 352,039 | 11/1886 | Carroll | 24/200 X |
| 1,469,929 | 10/1923 | Ledwinka | 24/168 |
| 1,541,701 | 6/1925 | Gaunt | 24/200 X |
| 2,326,328 | 8/1943 | Bush | 24/170 |
| 2,648,880 | 8/1953 | Brown | 24/23 |
| 3,206,816 | 9/1965 | Vilcins et al. | 24/74 |
| 3,605,204 | 9/1971 | Amundsen | 24/171 |
| 3,823,443 | 7/1974 | Takabayashi | 24/186 |
| 3,864,757 | 2/1975 | Hartigan | 2/114 |
| 3,969,792 | 7/1976 | Hattori | 24/74 |
| 4,117,573 | 10/1978 | Nakamura | 24/74 |
| 4,348,775 | 9/1982 | Haslbeck | 2/452 |
| 4,370,782 | 2/1983 | Aronica | 24/198 |
| 4,400,855 | 8/1983 | Stuart | 24/200 |
| 4,527,292 | 7/1985 | Kasama et al. | 2/452 |
| 4,564,960 | 2/1986 | Nishiyama | 2/452 |
| 4,674,155 | 6/1987 | Turtle et al. | 24/170 |
| 4,720,765 | 1/1988 | Weiss | 24/198 X |
| 5,177,837 | 1/1993 | Rekuc | 24/200 X |
| 5,181,280 | 1/1993 | Zachry, Jr. | 24/170 X |

*Primary Examiner*—James R. Brittain

*Attorney, Agent, or Firm*—Marger, Johnson, McCollom & Stolowitz, P.C.

[57] ABSTRACT

A clasp having an open side, a transverse bight bar above the base and having a distal end toward the open side of the base, an operable cover having an open position and a closed position, the base, the bight bar and the cover in said closed position defining an enclosed U-shaped strap receiving channel, and the base, the bight bar and the cover in its closed position adapted for clampingly engaging a looped strap portion received within the U-shaped strap receiving channel.

19 Claims, 2 Drawing Sheets

STRAP CLIP AND RETAINER

BACKGROUND OF THE INVENTION

This invention relates to clasps and buckles designed to position and hold a strap at a desired functional length, which are numerous and well known. In a first example, locking or clasping members frictionally secure the positioned strap. In a second example, the strap's free end is threaded through an aperture or slotted frame member and around one or more crossbars. Tensional loads applied on the working side of the strap pull the entwined strap portion into a tighter frictional relationship or cinch with the buckle structure.

It is recognized however, that threading the strap's free end through a buckle frame structure and around crossbars can be time consuming and difficult, particularly if the user is experiencing diminished dexterity due to conditions such as cold or wetness. See Haslbeck, U.S. Pat. No. 4,348,775.

SUMMARY OF THE INVENTION

It is an object of this invention to provide a convenient, simple locking clasp which provides easy strap insertion and adjustment without threading a strap free end through slots or apertures, and which securely retains the strap in position by providing frictional clasping forces and cinching forces.

The following preferred embodiments of this invention achieve the desired results with a simple design which lends itself to economic manufacture in a number of materials and by a number of processes, but particularly by the injection molding of thermoplastics, and stamping of sheet metal. Since no special frictional or locking structures are required on the strap itself, further economy in manufacture and greater selection for specific tasks is possible. A wide range of available strap types, colors and ease of adjustment under adverse climatic conditions make this invention particularly well suited for outdoor apparel.

Briefly, the invention consists of a rectangular base, a cantilevered strap retaining bight bar (bight bar), a hinged or snap fitting frictional cover, and strap alignment posts.

The bight bar is attached at one edge of the base's length near the center. It rises perpendicularly from the base a sufficient distance to permit the strap to be inserted under the bight bar and then the bight bar angles to be cantilevered roughly parallel over the strap retainer base plate, extending transversely across the width with distal end, and terminating over, and in line with the open side of base's opposite edge.

In another embodiment the bight bar angles from the perpendicular attachment point at the base plate edge and extends transversely across and away from the base plate. Again, the free or distal end of the bight bar terminates over, and parallel to the base's open and opposite edge, but at a somewhat greater distance from the base than at the perpendicular attachment point. This greater distance facilitates placement of the strap between the base and the bight bar. In a third embodiment, the juncture of the strap bight retaining bar and base plate forms an acute angle between their inner surfaces into which one edge of the strap may be jammed.

The strap alignment posts are situated near the end of the base opposite the end for strap attachment, with their inside edges spaced to be as wide, or slightly wider than the width of the strap. Since the retainer has no aperture, the user may insert the strap into the retainer by grasping the strap's free end and pulling it longitudinally along the base plate between the strap alignment posts, and under the bight bar, removing slack from the strap and positioning it for locking in the retainer. The user then folds the excess strap back over the bight bar, and places it between the strap alignment posts so that the slack end is resting on top of the first strap course.

The strap is now positioned for locking by pivoting or snapping the frictional cover into place, forcing the bight bar down upon the strap portion situated against the base, and forcing the interior wall of the cover down against the strap course situated over the top of the bight bar, frictionally locking the strap in the retainer.

When a tensional load is applied to the working side of the strap, cinching force between the enclosed strap and the forward edge of the bight bar are applied as well.

A clasp according to the present invention may also include means at one end of the base for attaching the clasp to an article. The attaching means may be in the form of flexible, sewable tabs permitting clasp attachment directly to a cloth article, or it may be in the form of an enclosed loop for securing an opposing strap in a fixed position. Additionally, in the case of athletic eyewear for example, the clasp may be molded or stamped as an integral part of the goggles.

The foregoing and other objects, features and advantages of the invention will become more readily apparent from the following detailed description of the preferred embodiments of the invention which proceeds with the reference to the accompanying drawings.

DETAILED DESCRIPTION OF THE PREFERRED EMBODIMENTS

Figure 1:
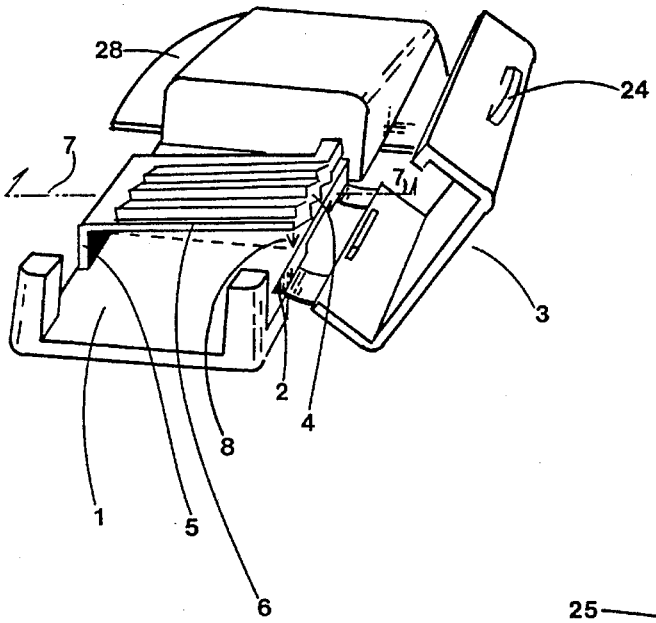
FIG. 1 of the invention shows a strap retainer with a hinged frictional cover in the open position. This figure shows the strap retainer embodied with flexible, sewable tabs for attachment to a cloth article.

Turning to the drawings, FIG. 1 shows one embodiment of clasp according to the present invention in its open position and clearly illustrates many of the features of this invention. A flat, essentially rectangular base is shown at 1. In this embodiment a positioning indention 2 is formed on the longitudinal edge, and open side of the base, adjoining the hinged, locking frictional cover 3, which it positions and holds longitudinally when the cover is pivoted into the locked position.

Figure 7:
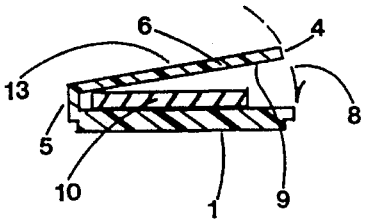
FIG. 7 shows the strap retainer illustrated in FIG. 1 divided sectionally along line 7—7.
Figure 9:
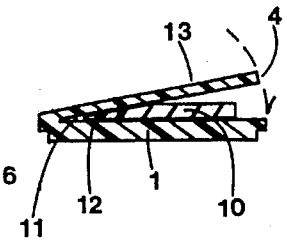
FIG. 9 shows a sectional view similar to FIG. 7, but where the retainer base plate and strap bight retaining bar inner surfaces form an acute angle between which one edge of the adjustable strap can be jammed.

A strap bight retaining bar (bight bar) 4 is attached at one edge of the base's length near the center, and is cantilevered over the base transversely. In the embodiment shown in FIGS. 1 and 3, the bight bar 4 rises at 5 perpendicularly from the base plate edge a distance which permits the strap to be inserted between the base and the strap bight retaining bar. FIG. 1 and FIG. 7 show how the cantilevered bight bar may angle 6 over and away from the base, so that its free or distal end terminates above the base a distance somewhat greater than the distance of perpendicular rise shown at 5. FIG. 9 shows another bight bar embodiment described below.

Figure 8:
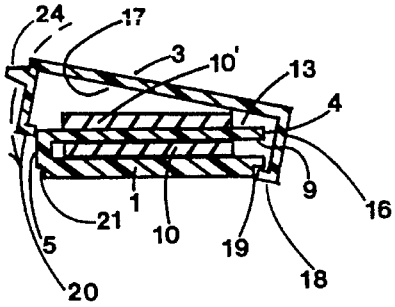
FIG. 8 shows a similar sectional view of a strap retainer as in FIG. 7, but with the strap bight retaining bar parallel to the retainer base plate, and a sectional view of the frictional cover plate shown in FIG. 2 divided along line 22—22, in which the frictional cover plate has been pivoted into a nearly locked position over the strap retainer.

Dividing line 7—7 indicates a sectional view of the strap retainer shown in FIG. 7. FIG. 8 shows a sectional view similar to FIG. 7, but with the frictional cover 3 also shown sectionally as divided along line 22—22 in FIG. 2, and pivoted into the nearly locked position over the strap retainer. Now, comparing FIG. 7 to FIG. 8, in FIG. 7, the strap bight retaining bar 4 has some flexibility in the direction of the base 1 as indicated by arrow 8. The bight bar's inner surface 9 frictionally engages the adjustable strap 10 between the bight bar 4, and the base 1. This occurs as shown in FIG. 8, when the user positions the locking frictional cover 3 on top of the strap bight $\mathbf{10}^1$, and presses the cover into locking engagement with the retainer base plate 1. The frictional cover's inner surface 17 presses against the strap bight $\mathbf{10}^1$, flexing the bight bar down upon the strap 10, and forcing it into a clamped, frictional engagement between the inner surface of the bight bar 9, and the retainer base 1.

FIG. 9 shows an embodiment of this invention where the bight bar 4 joins the retainer base 1, forming an acute angle between their inner surfaces at 11, and spaced to permit the jamming of one edge 12 of the adjustable strap 10 between the inner surfaces. This allows the user to close and lock the retainer without the strap moving from the desired position. As in FIG. 7, flexibility of the bight bar 4 frictionally holds the strap 10 between the bar and the base when the retainer is in the closed, locked position.

Figure 2:
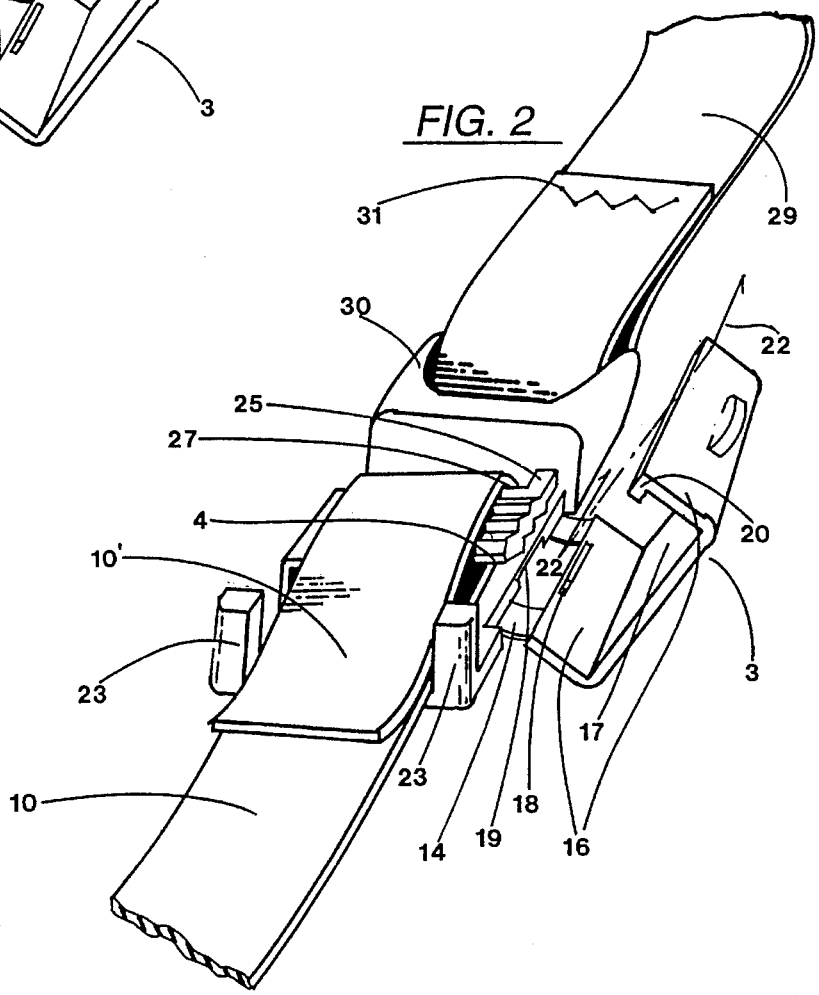
FIG. 2 illustrates the same retainer as shown in FIG. 1, but with a fixed anchoring strap in place of sewable tabs. Here also is a strap portion positioned around the strap bight retaining bar.

Turning now to FIG. 2 and the locking frictional cover plate 3.

In this embodiment of the invention, the frictional cover plate is unitary with the rest of the retainer, manufactured in one process, and of the same semi-flexible material such as nylon. During the manufacturing process, a hinge is formed at 14 attaching the base plate and the cover plate. The hinge is flexible because it is thinner than either the base or cover plate.

Figure 3:
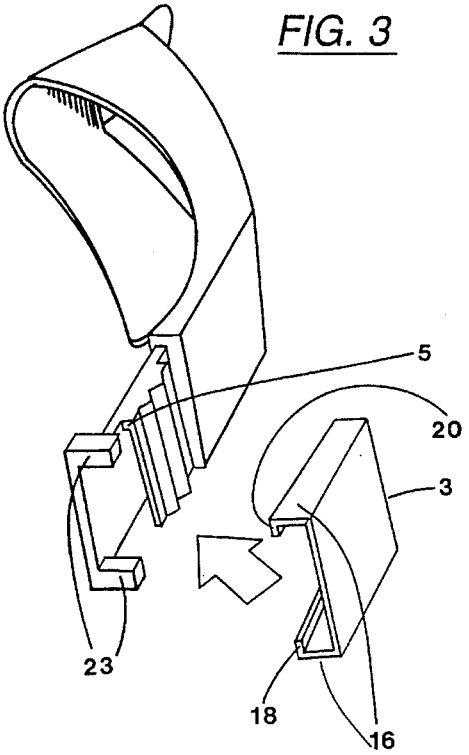
FIG. 3 illustrates the invention attached to the right eyepiece of a pair of swimming goggles. In this embodiment the frictional cover is separate from the retainer and snaps into place as indicated by the arrow.

FIG. 3 shows the cover plate 3 embodied separately from the strap retainer, with an arrow indicating how it is positioned and snaps into place over the strap retainer.

Figure 4:
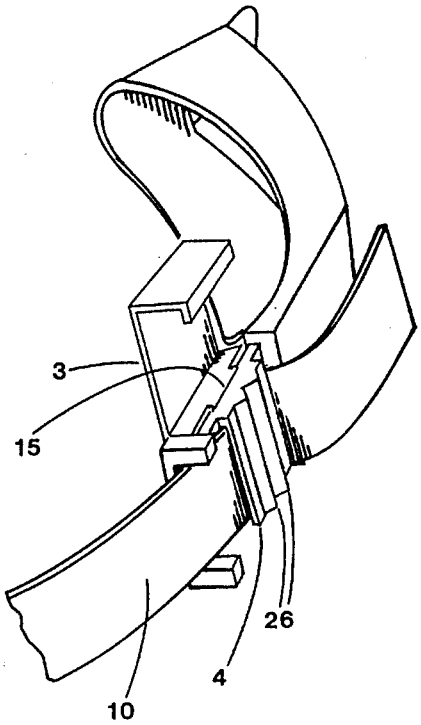
FIG. 4 also shows the retainer attached to a goggle eyepiece, but here with an opened, hinged frictional cover. Shown also is a head strap portion slipped into position through the strap alignment posts and under the strap bight retaining bar.
Figure 5:
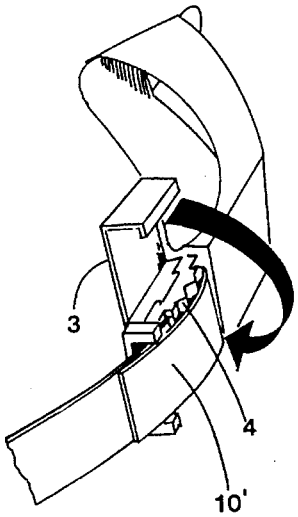
FIG. 5 illustrates the same goggle eyepiece and strap portion, but with the free end of the strap now folded over the strap bight retaining bar. A dark arrow indicates how the hinged frictional cover swings into the closed position.
Figure 6:
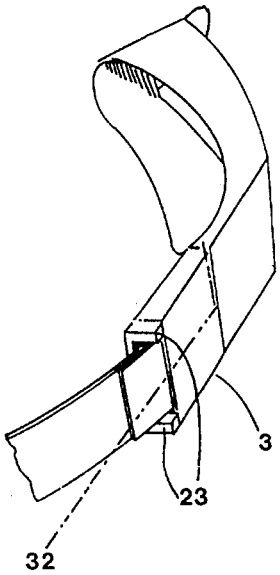
FIG. 6 shows the goggle eyepiece with the strap retainer and frictional cover in the locked position, strap retained.

FIGS. 4 through 6 show another configuration in which a mechanical hinge 15 located at one edge of the base plate's length attaches the frictional cover plate, so that it pivots as shown by the dark arrow in FIG. 5, to cover and compress the strap bight $\mathbf{10}^1$ surrounding the bight bar 4. FIG. 6 shows the strap retainer and frictional cover in the closed and locked position.

Figure 10:
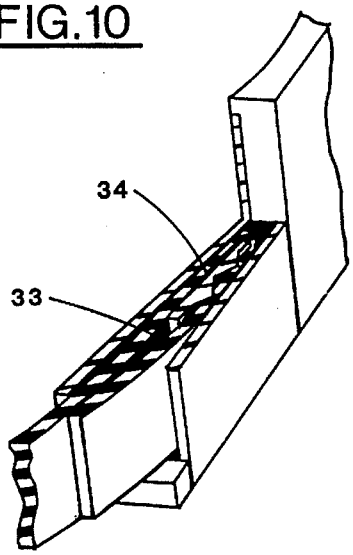
FIG. 10 illustrates a portion of FIG. 6 enlarged, and cut away along line 32 to show a looped strap portion received within the U-shaped strap receiving channel formed when the retainer is in the closed position.

FIG. 10 shows a portion of the clasp in FIG. 6 sectioned along line 32 to illustrate the enclosed U-shaped strap receiving channel 33 and the clamped strap loop portion 34 contained within the channel when the clasp is in the closed and locked position.

Clearly shown in FIG. 2, the locking frictional cover has extensions 16 which in the locked position situates the cover over the bight bar a distance which is close enough for the cover's inner surface 17 to apply the inward compressing force to the strap bight $\mathbf{10}^1$, and clamping the strap securely within the retainer.

A means for locking the frictional cover 3 to the base 1 is provided by a latching structure. FIG. 2 shows a latching bar 18 formed laterally along the edge of the side extension 16, positioned to engage the retainer base 1 when in the closed position. The base plate is notched at 19 to receive the latching bar 18. A second latching bar 20 is formed on the opposite side extension 16 and extends its full length. Turning now to FIG. 8, because the frictional cover has some flexibility, when it is pivoted into the locking position the latching bar deflects slightly against the perpendicular portion of the strap bight retaining bar 5, and the cover deforms slightly to allow passage of the latching bar 20 past the bight bar to be received by the locking notch 21 formed in the longitudinal edge of the base plate 1. The flexed frictional cover returns to its original shape, locking the cover to the retainer.

FIG. 2 show strap alignment posts 23 formed near the edge of the retainer base which receives the working end of the adjustable strap 10. The alignment posts are perpendicular to the base and spaced as wide, or slightly wider than the width of the adjustable strap. The strap alignment posts facilitate placement of the strap against the base, and helps properly position it under the bight bar. They also permit positioning of the folded strap bight $\mathbf{10}^1$ over the strap portion now resting against the base. A second function for the strap alignment posts is shown in FIG. 3, where the locking frictional cover 3 is detached from the strap retainer body. As shown in FIG. 6, with the frictional cover 3 in the locked position, strap alignment posts 23 prevent the cover from moving longitudinally off the retainer.

FIG. 1 shows a tab 24 formed on the frictional cover as a finger grip means to assist the user in opening and closing the strap retainer.

Shown most clearly in FIG. 2 is a projection 25 which forms a stop on the forward free edge of the bight bar 4, preventing the strap from working off the bar during adjustment.

Projections 26 of a saw tooth profile shown clearly in FIG. 4, are formed on the strap bight retaining bar 4 extending the length of the bar to concentrate frictional forces transversely against the strap. Strap engaging projections or teeth are well known in the art of clasps and strap retainers. Additionally, cinching forces may be applied to the forward edge 27 of the bight bar, identified in FIG. 2. When the strap is locked in the retainer and under a working load, tensional forces may cause the strap 10 to slip slightly between the retainer base plate and the inner surface of the bight bar. Since the strap portion $\mathbf{10}^1$ between the frictional cover and the bight bar remains secure, frictional forces are concentrated against the bight bar forward edge 27, cinching the strap more securely in the retainer.

The strap retainer may be affixed to a wide variety of items. FIG. 1 show flexible sewable tabs 28 for attaching the retainer to a cloth item. FIG. 2 shows a fixed retainer attachment strap portion 29 looped through a slotted structure 30, and secured to itself with stitching 31. FIGS. 3 through 6 show a strap retainer formed to the right eyepiece of a pair of swimming goggles.

Having described my invention in detail, it will be apparent to those skilled in the art that numerous modifications can be made without departing from the spirit and scope of the invention, all of which are intended to be claimed.

I claim:

1. A clasp comprising:

a base having a bottom wall, a side wall extending upwardly from the bottom wall, an open top and an open side;

a transverse bight bar above the bottom wall having a fixed end connected to the side wall and a distal end toward the open side of the base;

an operable cover having a top wall and a side wall, the cover having an open position and a closed position; and the base, the bight bar and the cover in said closed position defining a U-shaped strap receiving channel having a depth selected so that said base, bight bar and cover clampingly engage a strap portion received within the U-shaped strap receiving channel.

2. A clasp according to claim 1 wherein the cover is hingedly connected to the base.

3. A clasp according to claim 1 wherein the cover is removable from the base.

4. A clasp according to claim 1 further comprising a pair of spaced apart strap alignment posts extending upwardly from the base.

5. A clasp comprising:

a body having a base having a bottom wall, a side wall, an open top and an open side, a transverse bight bar above the bottom wall having a first end connected to the side wall and a distal end toward the open side, and an operable cover;

the clasp having a first open configuration including an open side for receiving a looped strap portion into the clasp and around the bight bar; and the clasp having a second closed configuration wherein the base, the bight bar and the cover cooperatively define a U-shaped strap receiving channel, and wherein the base, the bight bar and the cover clampingly engage the looped strap portion within the strap receiving channel.

6. A clasp according to claim 5 wherein the clasp in the open configuration includes the cover in an open position, and wherein the clasp in the closed configuration includes the cover in a closed position.

7. A clasp according to claim 5 wherein the cover is hingedly connected to the base.

8. A clasp according to claim 5 wherein the cover is removable from the base.

9. A clasp according to claim 5 further comprising a pair of spaced apart strap alignment posts extending upwardly from the base.

10. A strap assembly comprising:

a strap; and a clasp comprising a base having a bottom wall, a side wall extending upwardly from the bottom wall, an open top and an open side, a transverse bight bar above the bottom wall having a fixed end connected to the side wall and a distal end toward the open side of the base, an operable cover having a top wall and a side wall, the cover having an open position and a closed position; and the base, the bight bar and the cover in said closed position defining a U-shaped strap receiving channel having a depth selected so that said base, bight bar and cover clampingly engage a strap portion received within the U-shaped strap receiving channel.

11. Goggles comprising:

an eyepiece;

a strap connected to the eyepiece; and a clasp connected to the eyepiece, the clasp comprising a base having a bottom wall, a side wall extending upwardly from the bottom wall, an open top and an open side, a transverse bight bar above the bottom wall having a fixed end attached to the side wall and a distal end toward the open side, an operable cover having a top wall and a side wall, the cover having an open position and a closed position; and the base, the bight bar and the cover in said closed position defining a U-shaped strap receiving channel having a depth selected so that said base, bight bar and cover clampingly engage a strap portion received within the U-shaped strap receiving channel.

12. A clasp according to claim 11 wherein the cover is hingedly connected to the base.

13. A clasp according to claim 11 wherein the cover is removable from the base.

14. A clasp according to claim 11 further comprising a pair of spaced apart strap alignment posts extending upwardly from the base.

15. A clasp comprising:

a body having a base, a transverse, flexible bight bar above the base and having a distal end, and an operable cover;

the clasp having a first open configuration including an open side for receiving a looped strap portion having an upper course and a lower course into the clasp and around the bight bar; and the clasp having a second closed strap securing configuration wherein the cover presses the strap portion upper course against the flexibly attached bight bar deflecting it to press against the strap portion lower course, and forcing it into the base, and wherein the base, the bight bar and the cover clampingly engage the looped strap portion.

16. A strap assembly comprising:

a strap; and a clasp comprising a base having an open side, a transverse bight bar attached to the base opposite the open side, and having a distal end above the base and toward the open side of the base, a strap having a looped portion around the bight bar, an operable cover having a top wall and a side wall, the cover having an open position and a closed strap securing position; and the base, and the cover in said closed strap securing position clampingly engaging the looped strap portion and the bight bar.

17. Goggles comprising:

an eyepiece;

a strap connected to the eyepiece; and a clasp connected to the eyepiece, the clasp comprising a base having an open side, a transverse deformable bight bar cantilevered above the base and having a distal end toward the open side of the base, an operable cover having an open position and a closed position; and the base, the bight bar and the cover in said closed position defining a enclosed U-shaped strap receiving channel having a depth selected so that said base, bight bar and cover clampingly engage a looped strap portion received within the U-shaped strap receiving channel.

18. A strap assembly comprising:

a strap having a looped portion;

a clasp including a body having a base, a transverse, flexible bight bar above the base and having a distal end, and an operable cover;

the clasp having a first open configuration including an open side for receiving a looped strap portion having an upper course and a lower course into the clasp and around the bight bar; and the clasp having a second closed strap securing configuration wherein the cover presses the strap portion upper course against the flexibly attached bight bar deflecting it to press against the strap portion lower course, and forcing it into the base, and wherein the base, the bight bar and the cover clampingly engage the looped strap portion.

19. A goggle assembly comprising:

an eyepiece;

a strap connected to the eyepiece and having a looped portion;

a clasp connected to the strap and including a body having a base, a transverse, flexible bight bar above the base and having a distal end, and an operable cover;

the clasp having a first open configuration including an open side for receiving a looped strap portion having an upper course and a lower course into the clasp and around the bight bar; and the clasp having a second closed strap securing configuration wherein the cover presses the strap portion upper course against the flexibly attached bight bar deflecting it to press against the strap portion lower course, and forcing it into the base, and wherein the base, the bight bar and the cover clampingly engage the looped strap portion.

* * * * *